United States Patent [19]

Iwata

[11] 4,187,615

[45] Feb. 12, 1980

[54] PROCESS FOR TREATING FEATHERS AND CYCLONE USED FOR CARRYING OUT THE PROCESS

[75] Inventor: Takuzo Iwata, Osaka, Japan

[73] Assignee: Iwata Co., Ltd., Kyoto, Japan

[21] Appl. No.: 903,780

[22] Filed: May 5, 1978

[30] Foreign Application Priority Data

May 9, 1977 [JP] Japan ..... 52-53521

[51] Int. Cl.[2] ..... F26B 3/34

[52] U.S. Cl. ..... 34/1; 34/2; 34/12; 34/57 E

[58] Field of Search ..... 34/1, 2, 10, 12, 57 E

[56] References Cited

U.S. PATENT DOCUMENTS 3,081,553 3/1963 Miller ..... 34/2

3,111,398 11/1963 Jones ..... 34/1

*Primary Examiner*—John J. Camby

*Attorney, Agent, or Firm*—Haseltine, Lake & Waters

[57] ABSTRACT

Disclosed is a process for cleaning feathers in a cyclone, wherein feathers are introduced into the interior of a tubular-shaped cyclone in a tangential direction thereof, so that a swirl motion of feathers can be generated in the cyclone together with the downward movement of feathers toward the bottom of the cyclone. A flow of ionized air from compressed air nozzles provided with high voltage electrodes is discharged onto the feathers in a direction transverse to that of the swirl motion. A turbulent flow is created in the cyclone, thereby permitting the feathers to be effectively opened. The impurities attached to the feathers are thus separated therefrom. Thereafter, purified feathers are exhausted out of the cyclone. Ozone generated by the corona discharge in the high voltage electrodes causes the feathers to be sterilized, deodorized and decolorized.

15 Claims, 4 Drawing Figures

Fig. 3
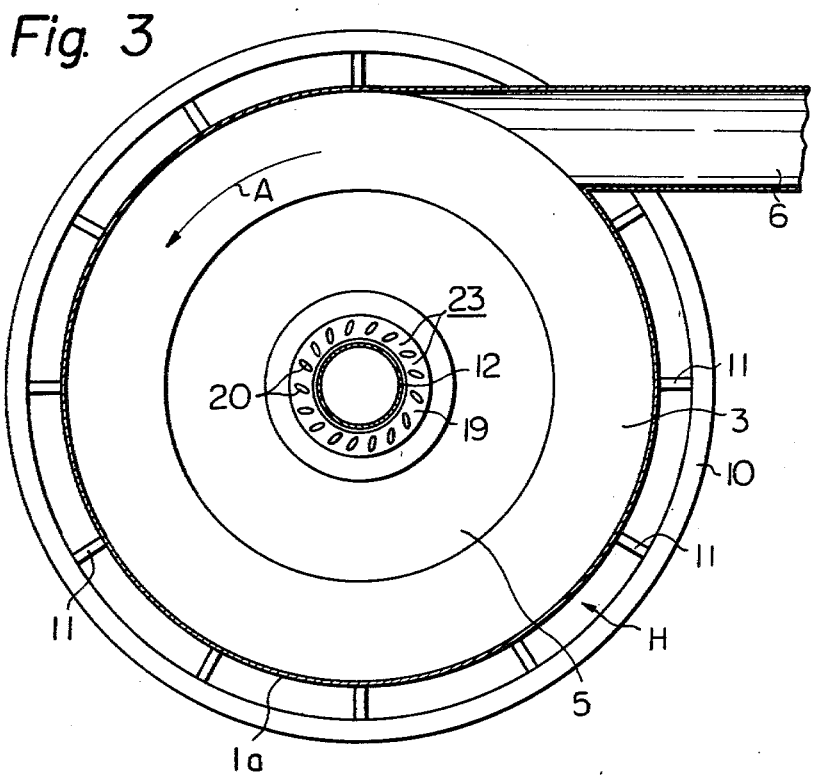
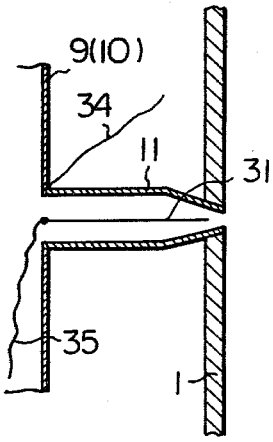
Fig. 4

PROCESS FOR TREATING FEATHERS AND CYCLONE USED FOR CARRYING OUT THE PROCESS

FIELD OF THE INVENTION

The present invention relates to a process and an apparatus for treating feathers, adapted for separating and cleaning the impurities attached to feathers.

BACKGROUND OF THE INVENTION

Generally speaking feathers include impurities such as dust attached thereto. In order to separate the impurities, the feathers, after being subjected to a washing process to remove oil therefrom and to a drying process, are supplied to a mixing box according to the prior art. The feathers are then mixed with each other in the mixing box to cause the impurities to drop toward the bottom of the box. However in such a prior art, the feathers are easily brought together with each other and the webs of each of the feathers are apt to be in contact with each other. Therefore, the prior art has a disadvantage in that the impurities attached to the feathers cannot be easily separated therefrom, and that the resultant feathers lack bulkiness. In addition to this, since the impurities are attached to the feathers by an electrostatic force, such impurities cannot be effectively separated by the mechanical mixing procedure. Furthermore, since the eggs of bird lice or ticks attached firmly to the feathers cannot be removed therefrom or killed by the prior art, the resultant feathers exhibit an inferior and undesirable quality. Still further, since the cleaning process in the prior art is carried out batchwise, the feathers from the preceding processes such as washing and drying are not continuously introduced into the cleaning process, which causes a low output efficiency in the treatment of the feathers.

SUMMARY OF THE INVENTION

An object of the present invention is to provide a process for treating feathers, which process can be used to effectively separate impurities from feathers.

Another object of the present invention is to provide a process for purifying feathers, by which impurities are separated from feathers by the action of an ionized air flow.

A still another object of the invention is to provide a process for purifying feathers, by which feathers are sterilized deodorized and decolorized during the purifying process of feathers.

A further object of the present invention is to provide a cyclone adapted for carrying out the feather purifying process.

According to one aspect of the present invention, a process for treating feathers, adapted for separating impurities attached thereto is provided, which method comprises the steps of: (a) intorducing feathers into a treatment zone; (b) generating, in the treatment zone, swirl motion of the introduced feathers together with the downward movement of feathers toward the bottom of the zone; (c) ejecting a flow of ions in a direction substantially transverse to the swirl motion of feathers under the action of a compressed air flow, in order to cause the impurities to be separated from the feathers while the separated impurities are exhausted to the outside of the cyclone; and (d) removing the purified feathers from the treating zone.

According to another aspect of the invention, a cyclone adapted for use to separate impurities attached to the feathers, is provided, which cyclone comprises: a housing of a substantially tubular shape; feather inlet duct means opened to the interior of the housing in a tangential direction for introducing feathers to be treated into the housing in such a manner that a swirl motion of the introduced feathers is generated together with a downward movement of feathers being directed toward the bottom of the housing; ejecting means mounted onto the housing along the circumferential direction thereof for generating flows of ionized compressed air in a direction substantially transverse to the swirl motion of the feathers, thereby causing a turbulent flow to be generated in the interior of the housing for separating impurities from the feathers; impurity exhaust duct means opened to the interior of the housing for exhausting the separated impurities to the outside of the cyclone; and feather outlet duct means opened to the interior of the housing at a position near the bottom of the cyclone for removing the purified feathers.

BRIEF DESCRIPTION OF THE DRAWINGS

FIG. 3 is a cross-sectional view taken along the 3—3 line of FIG. 2;

FIG. 4 is an enlarged cross-sectional view, indicating an arrangement of an ejection nozzle.

DESCRIPTION OF A PREFERRED EMBODIMENT

Figure 1:
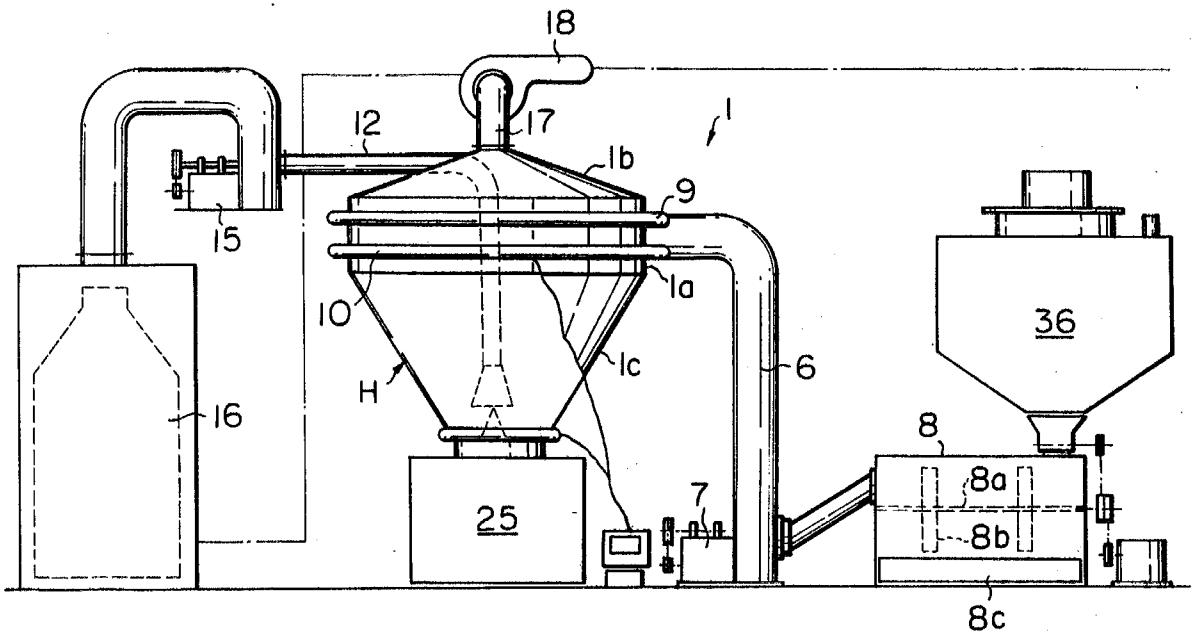
FIG. 1 is a schematic view of a system for treating feathers.
Figure 2:
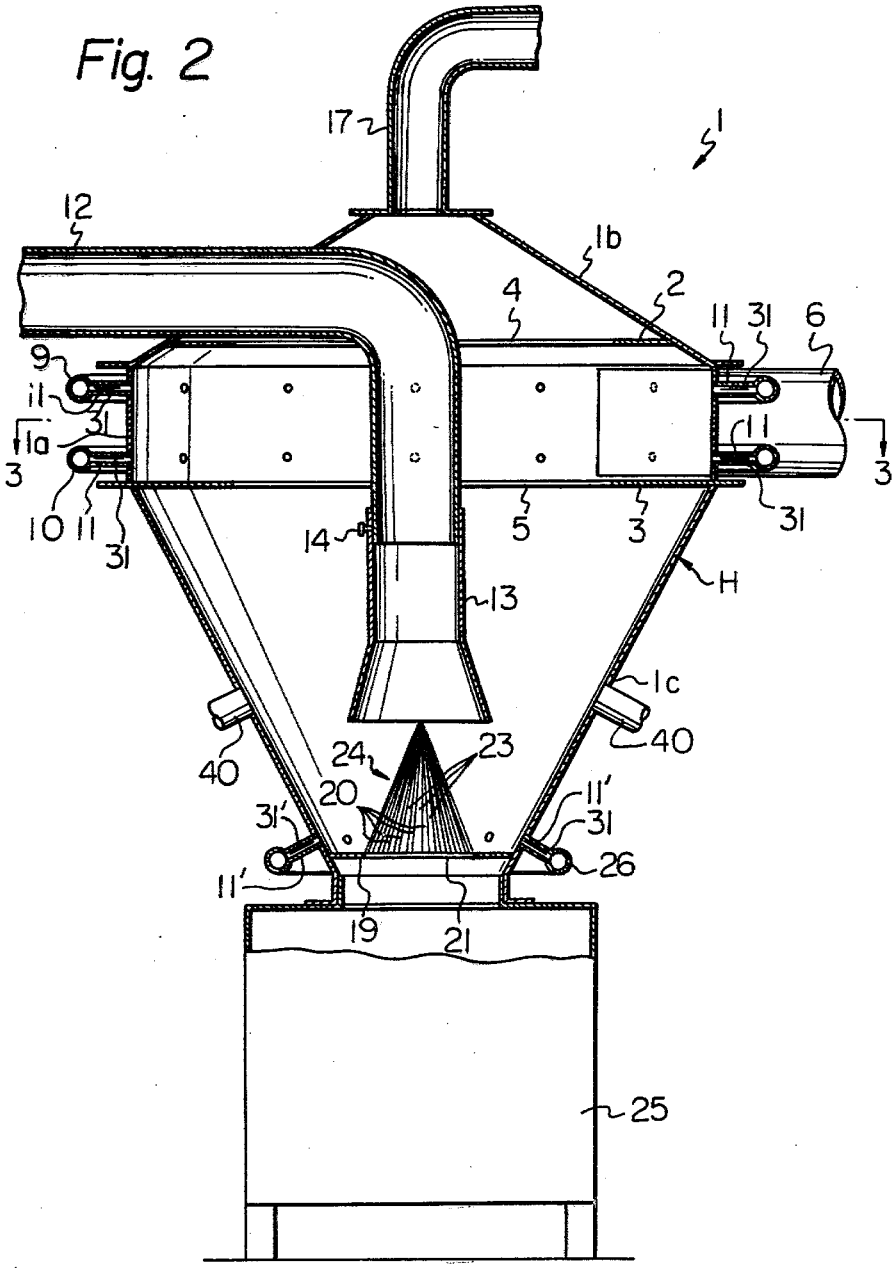
FIG. 2 is an enlarged vertical cross-sectional view of a cyclone according to the present invention and as shown in FIG. 1.

In FIG. 1 showing a total system for treating feathers according to the present invention, reference numeral 1 designates a cyclone adapted for separating impurities, for example, dust or eggs of bird lice or ticks, which are attached to feathers. The cyclone has a housing H comprised of a cylindrical middle portion 1*a* of a short length, an upper portion 1*b* of a truncated cone shape which is converged upwardly, and a lower portion 1*c* of a truncated cone shape which is converged downwardly. As shown by FIG. 2 which is a vertical cross-sectional view of the cyclone 1 in FIG. 1, a pair of plates 2 and 3 of an annular shape is arranged parallelly across the interior of the housing H. The plate 2 is, at the periphery thereof, secured to the inner surface of the upper portion 1*b* of the housing H. Whereas the plate 3 which is located on the lower side is, at the periphery thereof, secured to the inner surface of the middle portion 1*a* of the cyclone housing H. These plates 2 and 3, at the center thereof, define relatively large diameter openings 4 and 5, respectively. A feather inlet duct, which is designated by a reference numeral 6, is connected to the housing middle portion 1*a* in such a manner that one end of the duct 6 is opened to the interior of the housing H in a tangential direction of the tubular-shaped middle portion 1*a* as can be seen in FIG. 3. The feather inlet duct 6 is, on the other end, connected to a pressure feeding fan device 7, which is connected to a feather opener 8 for receiving loosened feathers therefrom, as can be seen in FIG. 1. The feather opener 8 is provided with a hopper 36 adapted for supplying feathers to be cleaned to the opener 8.

As shown by FIGS. 2 and 3, circular pipes 9 and 10 which are arranged around the middle portion 1*a* of the housing 1 are mounted thereto by arm members (not shown). These pipes 9 and 10 are connected to a compressed air source (not shown). Two rows of circumferentially speed apart nozzles 11 are arranged along the periphery of the middle cylindrical portion 1*a* of the housing H, so that ends of the nozzles 11 are connected to the middle cylindrical portion 1*a* at positions located between the upper and lower plates 4 and 5, so that the nozzles 11 are opened to the interior of the housing in a normal line direction of the cylindrical portion 1*a* as shown by FIGS. 2 and 3. The other ends of the nozzles 11 located remote from the housing are connected to respective pipes 9 and 10. A corona discharge electrode 31 is arranged in each of the air nozzles 11. As shown by FIG. 4, one nozzle 11 is grounded by means of an electrical wire 34, while the corona discharge electrode 31 is electrically connected to a high voltage generator (not shown) via an electrical wire 35. Thus, a corona discharge occurs between the inner surface of each of the nozzles 11 and its corresponding electrode 31.

As shown by FIG. 2, a feather outlet duct 12 is projected into the cyclone housing H at the upper position 1*a*, bent to pass through the openings 4 and 5 in the plates 2 and 3, respectively, and extended downwardly to a position near the upper end of the lower housing portion 1*c*. Connected to the end of the duct 12 by a bolt 14 is a feather outlet pipe piece 13 of a horn shape widened toward the bottom of the cyclone 1. The screw bolt 14 permits the adjustment of the position of the pipe piece 13 with respect to the bottom of the cyclone housing H.

As shown by FIG. 1, the feather outlet duct 12 is, on the other end thereof which is situated remote from the housing H, connected to a suction fan device 15, for removing the purified feathers from the cyclone. The fan device 15 is connected to a box 16 for storing the purified feathers therein.

An exhaust duct 17 is connected to the top end of the housing upper portion 1*b* so that it is opened to the interior of the cyclone 1. The duct 17 is connected, via an exhaust fan device 18, to a dust box (not shown).

A perforated annular plate 19 is at the periphery thereof fixedly secured to the lower truncated cone-shaped portion 1*c* at the bottom thereof, as shown by FIG. 2. Arranged on the annular plate 19 is a filter device 24 which comprises a plurality of blades 20 generally forming a conical shape, upper ends of which are converged at a position near the lower end of the pipe piece 13. Thus circumferentially spaced apart slits 23 are formed between the adjacent blades 20. Arranged below the cyclone housing H is a dust box 25 opened at the top portion thereof for receiving relatively heavy dust passed through the slits 23 of the filter unit 24.

Preferably, a row of second nozzles 11', which are upwardly inclined, is arranged in a circumferential direction of the cyclone at a position near the bottom so that the nozzles 11' are opened to the interior of the lower truncated cone-shaped portion 1*c* in a normal line direction thereof. The other end of the nozzles 11' are connected to a circular pipe 26 which is connected to the above-mentioned compressed air source to which the pipes 9 and 10 are also connected. A corona discharge electrode 31' is arranged in each of the nozzles 11 in a way similar to that previously mentioned with regard to FIG. 4.

Preferably, secondary air introduction pipes 40 are connected to the lower portion 1*c* of the housing of the cyclone 1 in a tangential direction thereof, for maintaining a high speed of the swirl motion of the feathers located near the bottom of the housing H.

A method for cleaning feathers by using the above-mentioned apparatus is now described.

The feathers to be treated, which are washed and dried in advance, are introduced into the hopper device 36 (FIG. 1) under a vacuum pressure. The feathers in the hopper 36 are continuously supplied to the feather opener 8 by opening the gate of the hopper 36.

As is well known to those skilled in this art, the feather opener 8 is provided with a rotating shaft 8*a* arranged in a perforated drum (not shown) and mixing blades 8*b* attached to the shaft 8*a*. Therefore, the supplied feathers are caused to be struck by the blades 8*b* and mixed with each other, so that impurities such as dust of a large dimension can be separated and dropped into a dust case 8*c* via the perforated drum (not shown).

It should be noted that an electric charge is formed in the feathers when the feathers are contacted with each other in the hopper 36 and in the opener 8. Therefore, the feathers are forcefully brought into contact with each other and the impurities thereof are firmly attached to the feathers during removal of the feathers from the opener 8. The electrical charge in the feathers is effectively decreased by the cyclone according to the present invention, as will be described later.

The feathers which are roughly purified by the mechanical procedure using the feather opener 8 are removed therefrom by the fan device 7 and then introduced into the cyclone 1 via the feather inlet duct 6 opened to the cylindrical portion 1*a* of the cyclone in a tangential direction thereof as shown by FIG. 3. Therefore, a swirl motion of the introduced feathers can be generated in the cyclone as shown by an arrow A in FIG. 3. Due to the presence of the pair of annular plates 4 and 5, the swirl motion occurring in the middle portion 1*a* of the housing H is prolonged sufficiently to permit the fine dust to be collected at the center of the housing H. Thus, impurities, with a density which is lower than that of the feathers such as fine dust are removed from the cyclone 1 by the operation of the exhaust fan 18 via the exhaust duct 17 which is opened to the interior of the cyclone from above.

During the swirl motion of the feathers cylindrical portion 1*a* as shown by the arrow A in FIG. 3, a flow of ionized compressed air from the nozzles 11 is ejected transversly to the swirl motion, which causes a turbulent flow to be generated. Due to such turbulence, each of the feathers is effectively opened so that impurities such as dust attached to the feathers at positions where the webs of the feathers are connected to the rachis of the feathers are exposed, thereby causing impurities to be effectively separated from the feathers.

A static field is generated between the upper and the lower annular plates 2 and 3 since air from the nozzles 11 is ionized by the corona discharge between the nozzles 11 and the corresponding electrodes 31. This static field decreases the static force occurring between the feathers and the impurities attached thereto, thus causing the feathers to be separated from each other and also causing fine dust particles located inside the feathers to be completely separated therefrom.

The corona discharge generated by the electrodes 31 also produces a large amount of ozone in the cyclone 1. Since ozone in the cyclone is effective for sterilizing feathers, the eggs of lice and the like attached to the feathers can thus be effectively killed. The ozone is also effective for deodorizing feathers. Furthermore, the ozone can also act as a decolorant. Accordingly, feathers are effectively bleached in the cyclone without using any chemical agent such as hydrogen peroxide. It should be noted that in the prior art the chemical bleaching process is absolutely necessary after cleaning of the feathers.

Impurities separated from higher density feathers but not removed by the exhaust duct 17 are moved downwardly by gravity. The impurities are transported, via the slits 23 of the filter unit 24 and the perforated plate 19, to the dust box 25 to be stored therein.

The feathers, which are under the effect of a swirl motion as shown by the arrow A in FIG. 3, are moved downwardly toward the bottom of the housing H by gravity and by the suction force of the feather outlet duct 12 connected to the suction fan device (or vacuum pump) 15. During the downward movement of the feathers, the secondary air ejected from the pipes 40 into the cyclone in a tangential direction of the lower truncated cone shape portion 1*c* of the housing operates to maintain the swirl motion of the feathers at a high speed at a position near the bottom of the cyclone 1. The diameter of the swirl motion of the feathers along the inner periphery of the cyclone decreases as the feathers move downwardly, since the lower portion 1*c* of the cyclone housing H is of a truncated cone shape converging toward the bottom of the cyclone. Due to the small diameter of the swirl motion at the position near the bottom of the cyclone housing H, the feathers are effectively collected and sucked by the pipe piece 13 of the outlet duct 12 into the box 16.

Prior to removal of the feathers by the feather outlet pipe pieces 13, the feathers at the position near the bottom are again subjected to a flow of ionized compressed air from the second row of nozzles 11 moving in a direction transverse to the direction of the swirl motion of the feathers, thereby causing a turbulent flow to be generated and thus opening the feathers. The impurities are again completely separated from the feathers due to the decreasing static force effect caused by the ionized air produced from the second nozzles 11. The ozone generated by the corona discharge in the electrodes 31 again causes the feathers to be sterilized, deodorized and decolorized, as is already explained hereinabove with regard to the first electrodes 31.

The purified feathers sucked by the duct 12 under the suctional force of the fan pump (or suction fan device) 15 are received by the box 16.

It should be noted that in place of the row of second nozzles 11', an air pipe provided therein with a corona discharge electrode can be mounted onto the lower portion 1*c* of the cyclone housing H. In this modification, ionized air can also be ejected toward the feathers in the cyclone for additionally separating the impurities from the feathers.

As is already described, the pair of annular plates 2 and 3 operates to maintain a prolonged swirl motion of the feathers in the middle portion 1*a* of the cyclone housing H. However, if such plates 2 and 3 are used, the amount of dust remaining in the treated feathers is to be large enough to cause the feathers to have an inferior quality.

The following table indicates the relations between the distance of a position in the cyclone from one of the nozzles 11 and the concentration of the ozone at the position, when the speed of the compressed air is 500 m/min and the amount of ozone generated at the place of the corona discharge electrode is 4.8 $cm^3$/min.

| distance of a position in the cyclone from the nozzle 11 | concentration of the ozone |
|---|---|
| 0.5 cm | 0.45 ppm |
| 1.0 cm | 0.11 ppm |
| 5.0 cm | 0.03 ppm |
| 30.0 cm | zero |

As is clear from the above table, it is necessary to generate the swirl motion of the feathers at a position near the nozzles 11, i.e., the inner surface of the cyclone housing H, in order to deodorize, decolorize and sterilize the feathers by means of the ozone.

It should be noted that the feathers have before being introduced into the cyclone, an electric charge as high as 20 to 25 KV, which causes the impurities to be strongly attached to the feathers. However, after the feathers are introduced into the cyclone, the electric charge is as low as 5 to 6 KV due to the effect of the corona discharge.

The advantages of the present invention are as follows.

1. The electrical charge in the feathers introduced into the cyclone can be decreased by the ejection of the ionized air, thereby causing the impurities to be easily separated from the feathers.

2. The feathers treated in the cyclone are sterilized, decolorized and deodorized by the ozone generated by the corona discharge without using any chemical agents.

3. Bulky feathers can be obtained since all of the feathers are completely opened in the cyclone.

4. Feathers from a preceding process such as washing or drying can be continuously introduced into the cyclone, which causes a high output efficiency in the treatment of the feathers.

5. The working area where the cyclone is mounted can be minimized, since the sterilization and deodorization processes are all carried out within the cyclone.

While the present invention is described with reference to the accompanying drawings, many modifications and changes can be made by those skilled in this art without departing from the scope of the invention.

What is claimed is:

1. A process for treating feathers, adapted for separating impurities attached thereto, comprising the steps of;

(a) introducing feathers into a treatment zone;

(b) generating, in the treatment zone, by horizontal swirl motion of introduced feathers together with downward movement of said feathers toward the bottom of said zone;

(c) ejecting a flow of ionized air transversely and inwardly directed to said swirl motion of said feathers from substantially the entire outer periphery of the swirl motions in order to cause said impurities to be separated from said feathers while said separated impurities are exhausted to the outside of said cyclone at the center of the swirl motion; and (d) removing purified feathers from said treating zone.

2. A process according to claim 1, wherein the diameter of said swirl motion of said feathers is controlled so that it decreases as said feathers approach the bottom of said zone, and said feathers are exhausted to the outside before they reach said bottom of said zone.

3. A process according to claim 2, wherein ejection of the ion flow is carried out both on the top portion of said zone for removing impurities from above and on the bottom portion of said zone for removing impurities from below.

4. A cyclone adapted for use to separate impurities attached to feathers, comprising:

a housing of a substantially tubular shape;

feather inlet duct means opened to an interior of said housing in a tangential direction for introducing feathers to be treated into said housing in such a manner that a swirl motion of said introduced feathers is generated togehter with a downward movement of feathers being directed toward the bottom of said housing;

ejecting means mounted onto said housing along the circumferential direction thereof for generating flows of ionized compressed air in a direction substantially transverse to said swirl motion of said feathers, thereby causing a turbulent flow to be generated in said interior of said housing for separating impurities from said feathers; impurity exhaust means opened to said interior of said housing, for exhausting said separated impurities to the outside of the cyclone; and feather outlet duct means opened to said interior of said housing at a position near the bottom of said cyclone for removing purified feathers.

5. A cyclone according to claim 4, wherein the lower portion of said housing is formed as a truncated cone shape which is converging toward the bottom of said housing.

6. A cyclone according to claim 5, wherein said impurity exhaust means comprise a duct means mounted onto top portion of housing and a filter means mounted on the housing below the truncated cone shape portion.

7. A cyclone according to claim 5, wherein said ejecting means is mounted to an upper portion of said housing located above said truncated cone shaped portion.

8. A cyclone according to claim 7, further comprising a pair of spaced apart plates of an annular shape which are arranged in parallel across the interior of said housing in such a manner that said ejecting means is located between said plates.

9. A cyclone according to claim 8, wherein said feather outlet duct means extends through said pair of annular plates and has an end opened to said interior of said housing at a position spaced apart from the bottom of said lower truncated cone-shaped portion of said housing.

10. A cyclone according to claim 5, further comprising a second ejecting means mounted onto said lower truncated cone-shaped portion of said housing, for introducing an ionized compressed air flow to feathers located near the bottom, thereby causing a turbulent flow to be generated for separating impurities.

11. A cyclone according to claim 4, wherein said ejecting means comprises at least one nozzle means which is comprised of a row of circumferentially spaced apart nozzles which are opened to the interior of said housing, a circular pipe adapted for connecting said nozzles to a compressed air source, and a corona discharge electrode arranged in each of said nozzles.

12. A cyclone according to claim 11, wherein said ejecting means comprises, parallely spaced apart two nozzle means.

13. A cyclone according to claim 10, wherein said second ejecting means comprises a row of circumferentially spaced apart nozzles which are opened to the interior of said housing, a circular pipe adapted for connecting the nozzles said to a compressed air source of compressed air, and corona discharge electrode arranged in each of said nozzles.

14. A cyclone according to claim 6, said filter means comprises a plurality of circumferentially spaced apart upwardly converging blades which terminate at a position near the open end of said feather outlet duct means, and a dust box arranged to face the blades.

15. A cyclone according to claim 10, wherein at least one secondary air pipe is arranged above said second ejecting means, so that one end of said pipe is opened to the interior of said housing in a tangential direction thereof.

* * * * *